US008959944B2

(12) United States Patent
Levy

(10) Patent No.: US 8,959,944 B2
(45) Date of Patent: Feb. 24, 2015

(54) CENTRIFUGAL AIR CYCLE AIR CONDITIONER

(76) Inventor: George Samuel Levy, San Diego, CA (US)

( * ) Notice: Subject to any disclaimer, the term of this patent is extended or adjusted under 35 U.S.C. 154(b) by 350 days.

(21) Appl. No.: 13/607,710

(22) Filed: Sep. 8, 2012

(65) Prior Publication Data

US 2013/0000328 A1 Jan. 3, 2013

Related U.S. Application Data

(63) Continuation-in-part of application No. 12/856,652, filed on Aug. 14, 2010, now abandoned.

(60) Provisional application No. 61/254,717, filed on Oct. 25, 2009, provisional application No. 61/235,230, filed on Aug. 19, 2009, provisional application No. 61/533,067, filed on Sep. 9, 2011.

(51) Int. Cl.
*F25D 9/00* (2006.01)
*F25B 9/00* (2006.01)

(52) U.S. Cl.
CPC ..... *F25B 9/004* (2013.01)
USPC ..... 62/402; 62/401; 62/84

(58) Field of Classification Search
CPC ..... F25B 9/065
USPC ..... 62/84, 402, 401; 165/90; 418/101
See application file for complete search history.

(56) References Cited

U.S. PATENT DOCUMENTS 2,522,781 A 9/1950 Exner
2,586,002 A 2/1952 Carson, Jr. et al.
2,917,288 A 12/1959 Sims, Jr. et al.
3,874,188 A 4/1975 Zara et al.
3,999,400 A 12/1976 Gray
4,015,438 A 4/1977 Kinsell et al.
4,127,011 A 11/1978 Giles
4,177,005 A 12/1979 Bozung et al.
4,262,495 A 4/1981 Gupta et al.
4,374,469 A 2/1983 Rannenberg
4,430,867 A 2/1984 Warner
4,445,342 A 5/1984 Warner
4,535,606 A 8/1985 Rannenberg
4,550,573 A 11/1985 Rannenberg
4,553,407 A 11/1985 Rannenberg
RE32,100 E 4/1986 Rannenberg
4,840,036 A 6/1989 Spraker
5,086,625 A 2/1992 Momose et al.
5,121,610 A 6/1992 Atkinson et al.
5,311,749 A 5/1994 McAuliffe et al.
5,373,707 A 12/1994 Ostersetzer et al.
6,041,615 A 3/2000 Ostersetzer et al.
6,058,715 A 5/2000 Strang et al.

(Continued)

*Primary Examiner* — Cassey D Bauer
(74) *Attorney, Agent, or Firm* — George S. Levy

(57) ABSTRACT

The air conditioning system uses an air cycle thermodynamic process. The system comprises a centrifuge. This centrifuge includes at one of its ends, an axial inlet that funnels air into a centrifugal compressor rotating in unison with the centrifuge. The air is compressed, adiabatically heated and directed to a heat exchanger mounted in the rim of, and rotating with the centrifuge. The air is accelerated with respect the centrifuge by varying the centrifuge radius or by using forward leaning impeller blades. The air is cooled by the heat exchanger and directed to an expander also rotating with the centrifuge. The air is expanded and adiabatically further cooled. The cold air exits the centrifuge through an axial outlet located at the second end of the centrifuge.

17 Claims, 14 Drawing Sheets

(56) References Cited

U.S. PATENT DOCUMENTS

| | | | |
|---|---|---|---|
| 6,301,922 | B1 | 10/2001 | Ochi |
| 6,381,973 | B1 | 5/2002 | Bhatti et al. |
| 6,484,528 | B1 | 11/2002 | Piao et al. |
| 6,622,499 | B1 | 9/2003 | Gielda et al. |
| 6,658,873 | B2 | 12/2003 | Clarke et al. |
| 6,672,081 | B1 | 1/2004 | Albaroudi et al. |
| 6,966,198 | B2 | 11/2005 | Piccirilli et al. |
| 6,981,388 | B2 | 1/2006 | Brutscher et al. |
| 2005/0126204 | A1 | 6/2005 | Piccirilli et al. |
| 2009/0282828 | A1* | 11/2009 | Graf ..... 60/659 |

* cited by examiner

CENTRIFUGAL AIR CYCLE AIR CONDITIONER

This invention claims the priority benefit of U.S. Provisional Application No. 61/235,230 titled "Air Cycle Air-Conditioning Fan" filed on Aug. 19, 2009, and of U.S. Provisional Application No. 61/254,717 titled "Air Cycle Air-Conditioner" filed on Oct. 25, 2009, both of which are hereby incorporated by reference. Applicant claims priority pursuant to 35 U.S.C. Par 119(e)(i).

This invention is a continuation in part of application U.S. application with application Ser. No. 12,856,652 by Levy and titled "Centrifugal Air Cycle Air Conditioner" filed on Aug. 14, 2010, which is hereby incorporated by reference and which is to be abandoned.

This invention also claims the priority benefit of U.S. provisional application No. 61/533,067 titled "Centrifugal Air Cycle Air Conditioner" filed on Sep. 09, 2011 which is hereby incorporated by reference. Applicant claims priority pursuant to 35 U.S.C. Par 119(e)(i).

FIELD OF THE INVENTION

The present invention relates to air cooling devices, air conditioners, refrigerators, heat pumps and more particularly to air-cycle cooling systems. It also relates to cooling fans.

PATENTS INCORPORATED BY REFERENCE

In addition to the aforesaid patents applications, the following are incorporated by reference.

U.S. Provisional Application No. 61/254,717 by Levy titled "Air Cycle Air-Conditioner" filed on Oct. 25, 2009.

U.S. application with application Ser. No. 12,856,652 by Levy and titled "Centrifugal Air Cycle Air Conditioner. "

U.S. Pat. No. 3,860,300 by Lyman titled "Virtually Zero Powered Magnetic Suspension."

U.S. Pat. No. 3,885,839 by Habermann titled "Magnetic Bearing."

U.S. Pat. No. 3,899,223 by Baermann titled "Magnetic Bearing."

U.S. Pat. No. 3,909,082 by Ishikawa titled "Magnetic Bearing Devices."

U.S. Pat. No. 3,954,310 by Rava titled "Radial Magnetic Bearing."

U.S. Pat. No. 4,300,807 by Poubeau titled "Method and Device for balancing rotary bodies with passive radial and active axial magnetic suspension and for orienting their axis of rotation."

U.S. Pat. No. 4,340,261 by Wehde titled "Magnetic Bearing Arrangement."

U.S. Pat. No. 4,381,875 by Struder titled "Magnetic Bearins and Motor."

U.S. Pat. No. 5,166,566 by Bernhardt et al., titled "Magnetic Bearings For a High Speed Rotary Vacuum Pump."

U.S. Pat. No. 5,495,221 by Post titled "Dynamically Stable Magnetic Suspension/Bearing System."

U.S. Pat. No. 5,559,381 by Bodley et al., titled "Flywheel support System For Mobile Energy Storage."

U.S. Pat. No. 5,818,137 by Nichols et al., titled "Integrated Magnetic Levitation and Rotation System."

U.S. Pat. No. 5,831,362 by Chu et al., titled "Magnet-Superconductor Flywheel and Levitation System."

U.S. Pat. No. 5,847,480 by Post titled "Passive Magnetic Bearing Element with Minimal Power Losses."

U.S. Pat. No. 5,894,181 by Imlach titled "Passive Magnetic Bearing System."

U.S. Pat. No. 6,019,319 by Falbel titled "Momentum Wheel Energy Storage System Using Magnetic Bearings."

U.S. Pat. No. 6,043,577 by Bornemann et al., titled "Flywheel energy accumulator."

U.S. Pat. No. 6,111,332 by Post titled "Combined Passive Bearing Element/Generator Motor."

U.S. Pat. No. 6,118,199 by Lembke titled "Magnetic Bearings."

U.S. Pat. No. 6,448,679 by Imlach titled "Passive Magnetic Support and Damping System."

U.S. Pat. No. 6,570,286 by Gabrys titled "Full Magnetic Bearings with Increased Load Capacity."

U.S. Pat. No. 6,657,344 by Post titled "Passive Magnetic Bearing for a Horizontal Shaft."

U.S. Pat. No. 6,906,446 by Post titled "Halbach Array Generator/Motor Having Mechanically Regulated Output Voltage and Mechanical Poser Output."

U.S. Pat. No. 7,218,025 by McDonald titled "Rotational Magnetic Electrical Generating Device."

U.S. Patent Application 20030042812 by Post titled "Passive Magnetic Bearing for a Horizontal Shaft."

U.S. Patent Application 20030189383 by Fremery titled "Magnetic Bearing Arrangement."

U.S. Patent Application 20040037716 by Jaisle titled "Turbocharger with Magnetic Bearing System that Includes Dampers."

U.S. Patent Application 20040174079 by Izraelev titled "System for passive and Stable Suspension or a Rotor in Rotor/Stator Assemblies."

U.S. Patent Application 20050198956 by Fremery et al., titled "Exhaust Gas Turbocharger."

U.S. Patent Application 20080074010 by Jugmayr titled "Fan with Active Magnetic Bearing."

U.S. Patent Application 20080252162 by Post titled "Passive Magnetic Bearing Configurations."

U.S. Pat. No. 4,320,927 by Sertich titled "Dental Drill with Magnetic Air Turbine having Magnetic Bearings."

U.S. Pat. No. 6,424,067 by Samways titled "Centrifugal Separator."

U.S. Pat. No. 7,535,150 by Wilson titled "Centrifugal Turbine Blower with Gas Foil Bearings."

If any disclosures in the parent utility application and parent provisional applications, or in the patents incorporated herein by reference conflict in part or whole with the present disclosure, then to the extent of conflict, and/or broader disclosure, and/or broader definition of terms, the present disclosure controls. If such incorporated disclosures conflict in part or whole with one another, then to the extent of conflict, the later-dated disclosure controls.

BACKGROUND

A modern air conditioner used in cooling a building requires four basic operations: 1) a refrigerant fluid such as Freon® in gaseous phase is compressed. This compression heats the fluid. 2) The hot pressurized fluid is then passed through a heat exchanger located outside the building where it is cooled. 3) The fluid is then allowed to expand or evaporate. This depressurization contributes to further cooling the fluid. The depressurized cold fluid is then passed through a second heat exchanger located inside the building where it is allowed to absorb heat thereby cooling the inside of the building.

In the past, air conditioners and refrigerators have used fluids such as ammonia, chloromethane, and sulfur dioxide. However, these substances are toxic and their use is problematic. Newer fluids including the chlorofluorocarbon (CFC)

such as Freon® are non-toxic but have been shown to destroy the ozone layer. The Montreal Protocol on Substances that Deplete the Ozone Layer classifies Freon-11 and Freon-12 as Annex A substances and bans their production and consumption as of 1996.

The interim replacements for CFCs are hydrochlorofluorocarbons (HCFCs). Even though these compounds contain chlorine they deplete stratospheric ozone to a much lesser extent than CFCs. Yet, these fluids present another problem: they are super greenhouse gases and, molecule for molecule, they can trap infrared rays hundreds to thousands of times more efficiently than carbon dioxide.

One possible solution is to avoid the use of such fluids entirely, and to use air as a refrigerant fluid. Air cycle air conditioners are described in U.S. Pat. No. 2,586,002 by Carson et al, U.S. Pat. No. 3874,188 by Zara et al, U.S. Pat. No. 4,015,438 by Kinsell et al, U.S. Pat. No. 4,127,011 by Giles et al, U.S. Pat. Nos. 4,535,606 and 4,550,573 by Rannenberg, U.S. Pat. No. 4,553,407 by Rannenberg, U.S. Pat. No. 5,121,610 by Atkinson et al, U.S. Pat. No. 5,373,707 by Ostersetzer et al, U.S. Pat. No. 6,041,615 by Ostersetzer et al, U.S. Pat. No. 6,301,922 by Ochi, U.S. Pat. No. 6,381,973 by Bhatti, U.S. Pat. No. 6,484,528 by Piao, U.S. Pat. No. 6,966,198 by Piccirilli, U.S. Application 2005/0126204 by Piccirilli.

No air cycle air conditioner described in the prior art, however, offers the economy, reliability, efficiency and environmental sustainability of the present invention. Further features, aspects, and advantages of the present invention over the prior art will be more fully understood when considered with respect to the following detailed description and claims.

SUMMARY OF THE INVENTION

The proposed air conditioner implements the reverse Brayton cycle also called the Bell Coleman cycle by means of a centrifuge. This architecture allows the device to operate simultaneously as a compressor, heat exchanger and turbine. Hot outdoor air enters the device through an axial inlet. The air, propelled by a first set of impellers, acquires rotational kinetic energy, is compressed by the centrifugal force and is adiabatically heated as it reaches the rim of the centrifuge. The air is then further accelerated in its angular motion by a tapering of the centrifuge in the axial direction. This rapid motion of the air results in the thinning of the boundary layer and in the maximization of heat transfer in the heat exchanger. Furthermore, the conical shape of the wall counters the effect of friction and maintains the relative velocity. Near its exit, the centrifuge widens, causing the air to decelerate and match the centrifuge in rotational speed. As the air exits the heat exchanger, it is cool and compressed.

The air is then further decelerated by a second set of impellers, and directed back toward the axis where it is adiabatically decompressed and further cooled. The cold air exits through an axial outlet and is directed indoors. Kinetic energy cycles back from the second, to the first set of impellers through the common axle.

This proposed design is significantly more efficient than other air cycle systems because of the extreme reduction in the thickness of the boundary layer on both sides of the heat exchanger due to forced convection caused by the high rotational speed and the shape of the centrifuge. Other advantages of this approach include: a single moving part; a single heat exchanger; no global warming refrigerant fluid; energy efficiency; reliability and low noise.

DETAILED DESCRIPTION

Figure 1:
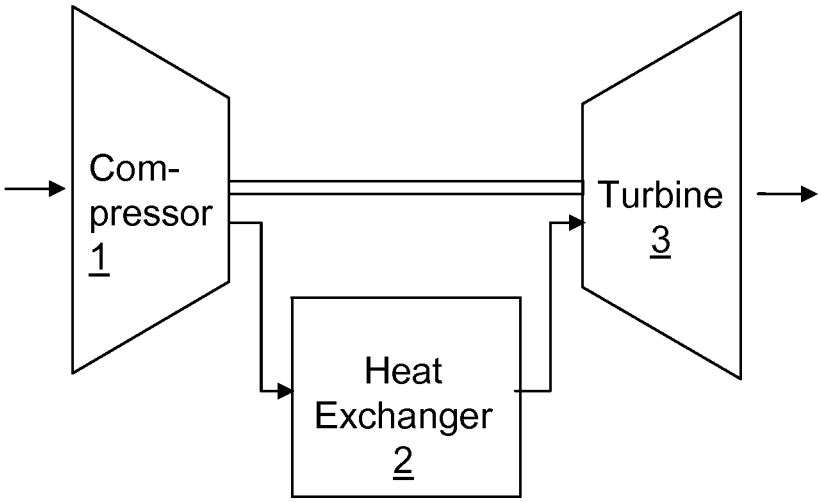
FIG. 1 (PRIOR ART)
FIG. 1 illustrates the reversed Brayton cycle (Prior art).

The device operates according to a reverse Brayton cycle also called an air refrigeration cycle or a Bell Coleman cycle shown in the prior art FIG. 1. In this well know cycle, the air is compressed adiabatically in a compressor 1. The air then traverses a heat exchanger 2 where it is cooled essentially at constant pressure. The air is then adiabatically decompressed and cooled in a turbine 3.

Figure 2:
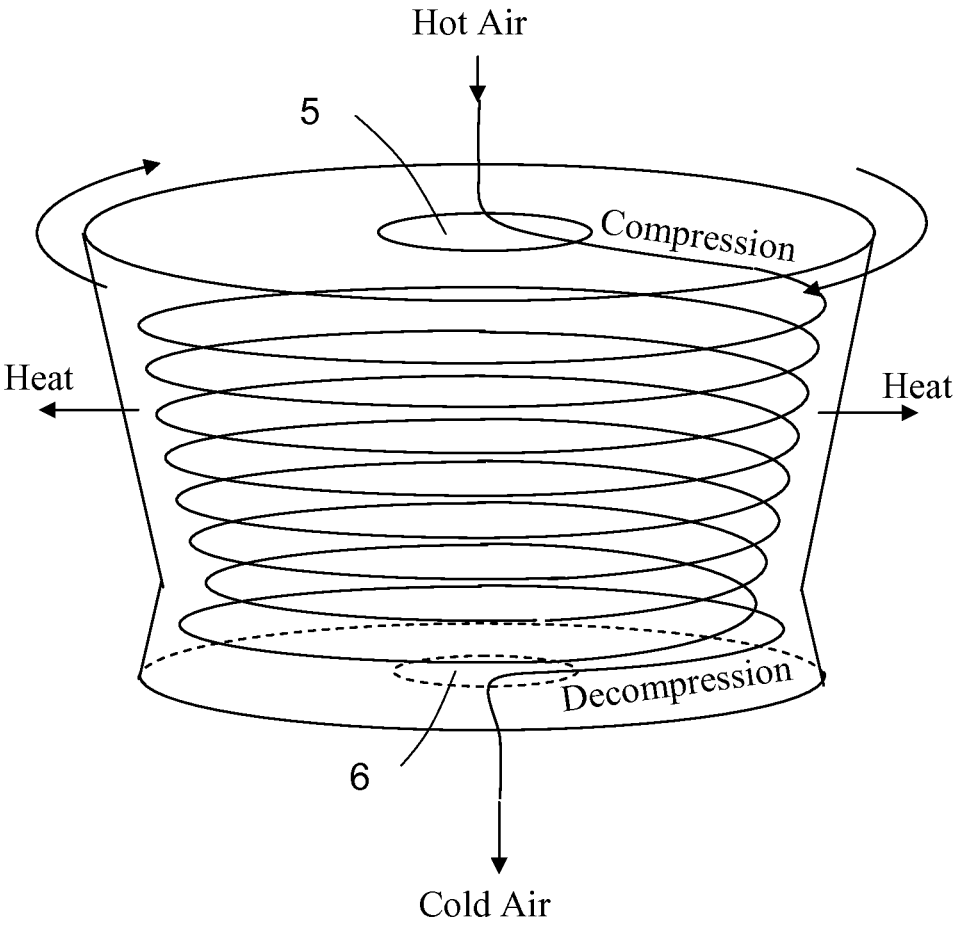
FIG. 2 illustrates the invention in a diagrammatical form.
Figure 3:
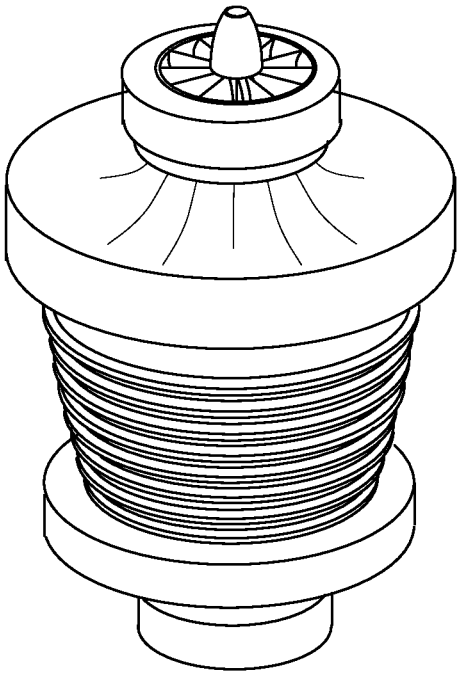
FIG. 3 provides a top view of the centrifuge.
Figure 4:
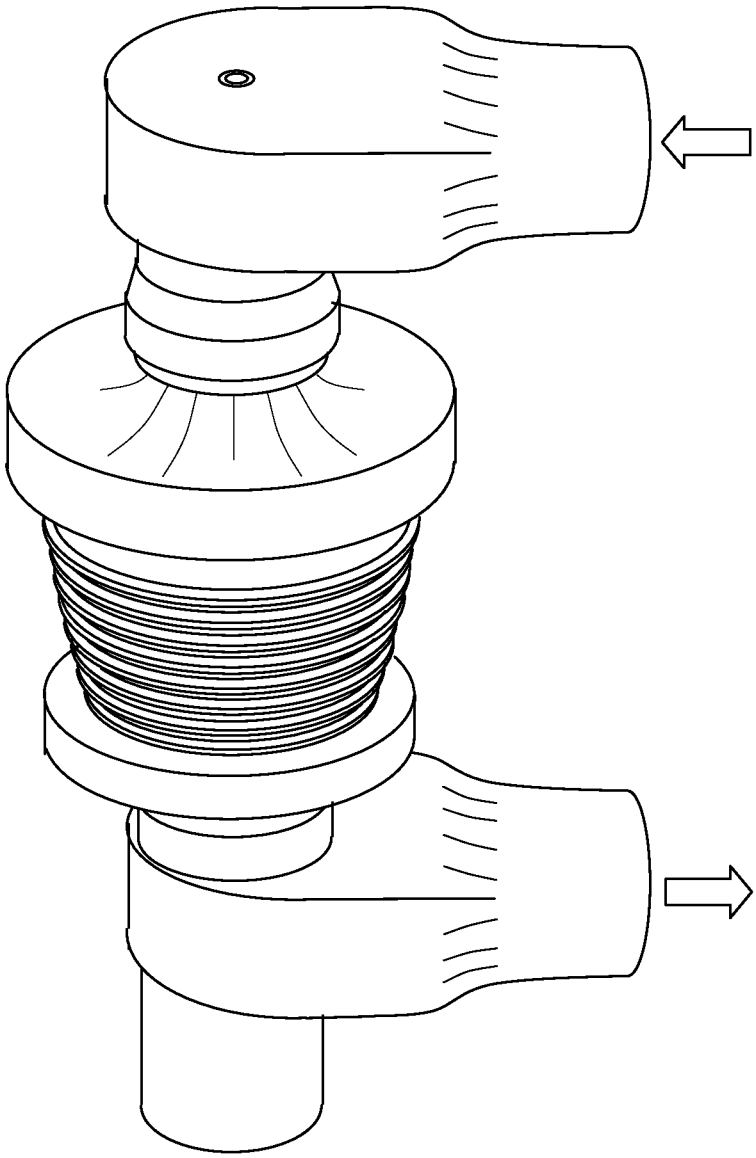
FIG. 4 shows a fully assembled device including the input and output manifold and the driving motor.
Figure 5:
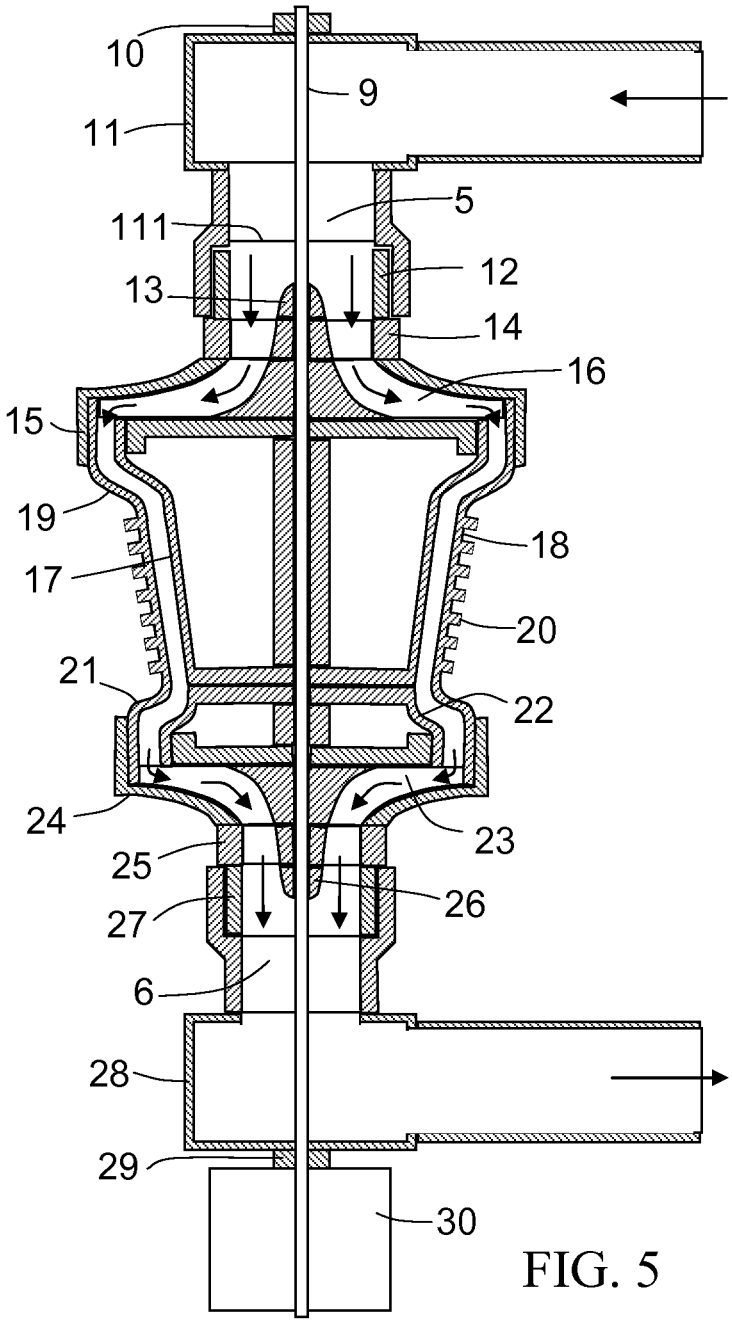
FIG. 5 shows the invention in cross-section.

The proposed air conditioner implements the reverse Brayton cycle by means of a centrifuge driven by an electric motor as shown in diagrammatical form in FIG. 2, and in fully assembled form in FIG. 3. All the parts in the figure rotate as a unit. FIG. 4 includes inlets and outlets and FIG. 5 shows the device in cross-section.

This architecture allows the device to operate simultaneously as a compressor, heat exchanger and turbine. Hot outdoor air enters the device through an axial inlet 5. The air, propelled by a first set of impellers 16, acquires rotational kinetic energy, is compressed by the centrifugal force and is adiabatically heated as it reaches the rim of the centrifuge. At that point, its rotational velocity is the same as that of the centrifuge.

As the air continues its progression, it begins to moves in the axial direction along the centrifuge's conical wall 18 which operates as a heat exchanger. The centrifuge deviates from a purely cylindrical shape in order to accelerate the air with respect the centrifuge's own rotation. The tapering 19 of the wall causes the air to accelerate with respect to the centrifuge and to move in a spiral path. This rapid motion of the air results in the thinning of the boundary layer and in the maximization of heat transfer in the heat exchanger. The conical shape of the wall 18 counters the effect of friction and maintains the relative velocity. Near its exit, the heat exchanger widens 191, causing the air to decelerate and match the centrifuge in rotational speed. As the air exits the heat exchanger, it is cool and compressed.

The air is then further decelerated by a second set of impellers 23, and directed back toward the axis where it is adiabatically decompressed and further cooled. The cold air exits through an axial outlet 6 and is directed indoors. Kinetic energy cycles back from the second 23, to the first set of impellers 16 through the common axle 9.

Figure 6:
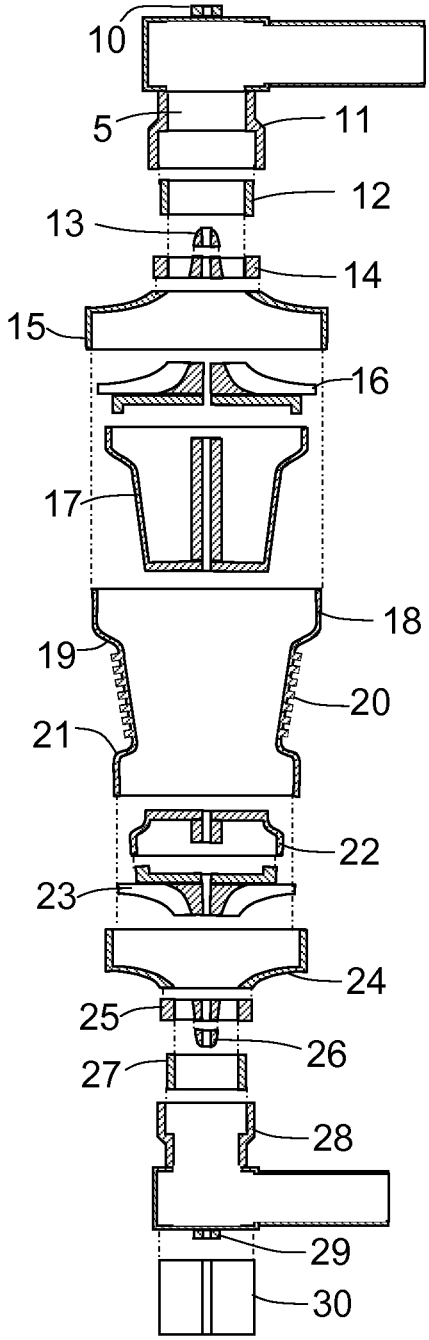
FIG. 6 provides an exploded view of the invention in cross-section.

In a preferred embodiment shown in cross section form in FIG. 5 and in exploded form in FIG. 6 the device comprises the following components:

An axle 9. This axle 9 is threaded at predetermined places allowing it to support nuts to hold all the components of the centrifuge together and allows kinetic energy to be recycled from the turbine to the compressor part of the device.

An air intake manifold 11 carrying a bearing 10 to support the axle 9. Baffles 111 can be positioned in the input duct to straighten the air flow before it enters the centrifuge. This manifold 11 conducts air from inside the building to the centrifuge where the air is cooled.

Bearings 10 and 29. Depending on the speed of the centrifuge the bearings could be mechanical ball bearings or could be of a different kind such as air bearing or magnetic bearing. Magnetic bearing technology is well know and is applicable to axle support as well as hub support of the centrifuge. For example the induction-based levitation system present in MAGLEV technology such as the Indutrack™ system can simplify the bearing design. It eliminates the need for complex control systems by using Halbach Arrays and simple closed loop coils. Inductrack™ achieves magnetic levitation by means of unpowered loops of wire in the track and permanent magnets (arranged into Halbach arrays) on the vehicle. A Halbach array is a special arrangement of permanent magnets designed to augments the magnetic field on one side of the array while cancelling the field on the other side. In MAGLEV, the track can be designed in two configurations, a "ladder track" and a "laminated track". The ladder track utilizes unpowered Litz wire cables, and the laminated track, stacked copper or aluminum sheets. At constant velocity, the only power required is to push the train forward against air and electromagnetic drag. As the magnets configured as a Halbach array with rotating magnetic field orientations, pass over the loops of wire, the sinusoidal variations in the field induce a voltage in the coils of the track. This voltage creates a current that coincides with the peaks of the field of the magnet array. The current in turn generates a magnetic field that repels the permanent magnets on the vehicle, creating the levitation effect.

The centrifuge can use passive magnetic bearings. This technology has been the subject of significant research. For example a study titled "A Passive Magnetic Bearing Flywheel" was conducted in February 2002 by Mark Siebert, Ben Ebihara, Ralph Jansen, Robert L. Fusaro, Wilfredo Morales, Albert Kascak, and Andrew Kenny and funded by NASA (Funding Number WU-274-00-00-00). The abstract of this study states: "A 100 percent passive magnetic bearing flywheel rig employing no active control components was designed, constructed, and tested. The suspension of the rotor was provided by two sets of radial permanent magnetic bearings operating in the repulsive mode. The axial support was provided by jewel bearings on both ends of the rotor. The rig was successfully operated to speeds of 5500 rpm, which is 65 percent above the first critical speed of 3336 rpm."

Foil bearings represent another technology applicable to support of the centrifuge. Foil or foil-air bearings are a type of air bearing. A shaft is supported by a compliant, spring-loaded foil journal lining. Once the shaft is spinning fast enough, the working fluid (in the case of the centrifuge the fluid is air), pushes the foil away from the shaft so that there is no more contact. The shaft and foil are separated by the air's high pressure which is generated by the rotation which pulls gas into the bearing via viscosity effects. A high speed of the shaft with respect to the foil is required to initiate the air gap, and once this has been achieved, no wear occurs. Foil bearings do not need external pressurization system for the working fluid, and are self-starting.

Rotating seal 12. The pressure differential across the seal 12 is low since the incoming air at the inlet is near atmospheric pressure and therefore the requirement on this seal is not stringent. Even if some air crosses the seal and is sucked into the device from the outside, this air will only refresh the circulating inside air.

A threaded nut 13, approximately conical in shape. This nut screws on the axle 9 and is used at the intake end to hold the centrifuge parts together as in a sandwich.

An intake fan 14 which sucks in air from the manifold and sends the air into the device.

An intake impeller cap 15 which covers the inlet impellers 16.

Figure 7:
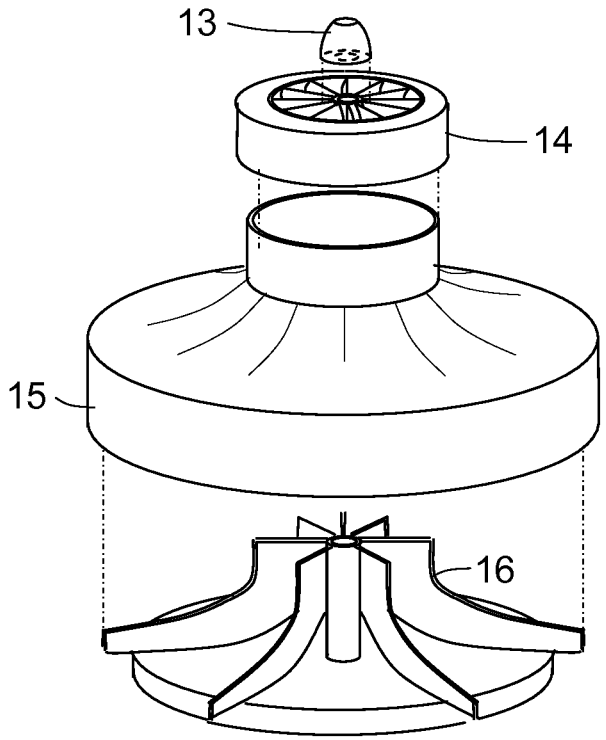
FIG. 7 shows a detailed exploded view of the input fan, impeller cap and impeller.
Figure 8:
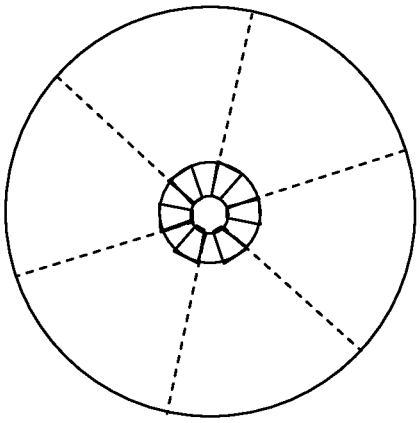
FIG. 8 shows an impeller design in which the blades are oriented in the radial direction.
Figure 8A:
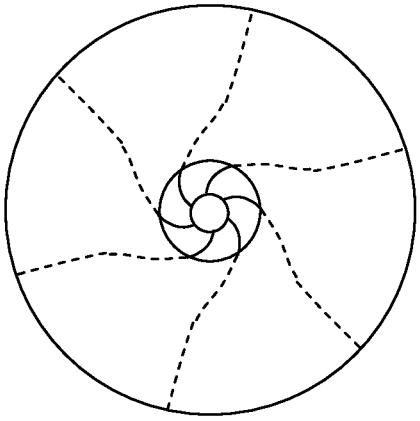
FIG. 8A shows an impeller design in which the blades are leaning forward, thereby accelerating the air to an angular velocity greater than that of the centrifuge.

Intake impellers 16 and their support disk which provide together with the input fan 14 the compressor function of the reverse Brayton cycle. FIG. 7 shows in detail a possible configuration for the impellers 16 and the fan 14, the cap 15 and the locking nut 13. Depending on the impeller design shown in FIGS. 8 and 8A, the air can leave the compressor at essentially the same speed, or at a different speed from, that of the centrifuge. Orienting the impeller blades in the radial direction as shown in FIG. 8 results in the air leaving the compressor at the same speed. Leaning the blades forward as illustrated in FIG. 8A results in the air leaving the compressor at a higher angular speed.

The hollow core 17 guides the air against the wall of the centrifuge.

The wall of the centrifuge 18 may carry fins 20 on its outer surface to improve heat flow to the environment. The wall 18 is shaped to control the angular speed of the air in the centrifuge. A first constriction 19 accelerates the air to a predetermined rotational speed higher than that of the centrifuge. This higher speed reduces the thickness of the boundary layer, which improves heat flow. This first constriction 19 is followed by conical segment that maintains the air at the desired rotational speed and counters the frictional losses. The conical segment 20 is followed by an expansion 21 that decelerates the air back to the centrifuge rotational velocity. The space between the inner side of the wall 18 and the core 17 defines the space for the air to flow through the heat exchanger. As can be appreciated, one of the innovations of this invention is that the heat exchanger rotates coaxially and synchronously with the compressor blades 16 and the turbine blades 23. The wall of the centrifuge is made of high conductivity material such as Aluminum or an Aluminum alloy to maximize heat transfer. In addition the material should have high tensile strength to withstand the centrifugal force.

A bulkhead disk 22. This component provides a counterpart to the core 17 and guides the air as it follows the expansion 21 of the centrifuge wall 18.

The outlet impellers 23 shown in detail in FIG. 7 and their support disk provide the turbine function of the reverse Brayton cycle. Their configuration is essentially the same as the inlet impeller and fan except that their ideal proportions may be slightly different because of the different temperature of the air going through them. The outlet impellers 23 are axially connected to the inlet impellers 16 and to the inlet fan 14 thereby allowing the recovery of some of the air's kinetic energy.

An outlet impeller cap 24 covers the outlet impellers.

An outlet fan 25 also recovers some of the kinetic energy of the air.

A threaded nut 26, approximately conical in shape. This nut screws on the axle and is used at the outlet end to hold the centrifuge parts together as in a sandwich.

Rotating seal 27. The pressure differential across the seal 27 is low since the outgoing air at the outlet is near atmospheric pressure and therefore the requirement on this seal is not stringent. If some air crosses the seal and is pushed out of the device into the environment, the loss of cool air results in a decrease in the device's efficiency.

An air outlet manifold 28 equipped with bearings 29 to support the axle 9. Baffles can be positioned in the output duct to straighten the air flow before it exits the centrifuge.

A motor 30 that drives the centrifuge. Many variations are possible. The motor could be conventional and conventionally drive an axle as shown in FIG. 5. Alternatively, the motor could be built into the input cap 15 or input fan 14 (or outlet cap 24 or outlet fan 26). These motors are sometimes called "hub motors" when they are incorporated in the wheel rims of a vehicle. The electric drive motors can also be outrunners in which the electromagnets are mounted in an internal stator and magnets are mounted on an external rotor.

To reduce turbulence and optimize air flow, it may be advantageous to use curved surfaces (smooth out angles) and to design the air flow path with a constant cross section area. (i.e., the area rule as is commonly known in aviation). Using such criteria would imply that the there would be an asymmetry in the volume allocated to the input side and the output side. If the air experiences a volumetric increase due to a relatively high drop in pressure across the heat exchanger and a relatively low drop in temperature, then the cross section of the air path at the output should be greater than the one at the input. FIG. 3 shows such a case. Conversely, if the pressure drop across the heat exchanger is relatively low and the drop in temperature is high resulting in a net decrease in the volume of air, then the cross section of the air path at the output should be smaller than the one at the input.

The performance of the air conditioner depends on the rotational speed of the rotor. The rotational speed is restricted by the material used to construct the device and by the bearing used. Relatively low rotational speed applications would lead to lower performance but could easily be implemented by mechanical bearings. Relatively high speed applications leading to better performance require bearings capable of operating at high speed. Substantial information can be found in the literature regarding such bearings, in particular bearings used for centrifuge and ultra centrifuge and bearings used in turbochargers. Of particular interest are the active magnetic bearings (which are relatively expensive), passive magnetic bearings and air foil bearings. If magnetic bearings are used it may be advantageous to combine the bearing mechanism with the electric drive mechanism. Mohawk Innovative Technology Inc. is one of the manufacturers of air foil bearings and hybrid foil magnetic bearings. Several patents regarding such bearings have been incorporated by reference.

Moisture can be extracted from the air before it is discharged by over-cooling it, allowing the moisture to condensate and then mixing the cold air with some air from the inside of the building.

A mesh shield can be mounted on the frame to completely surround and protect the spinning centrifuge and to reduce the possibility of injury in case a part of the centrifuge detaches itself during operation and flies off.

Figure 9:
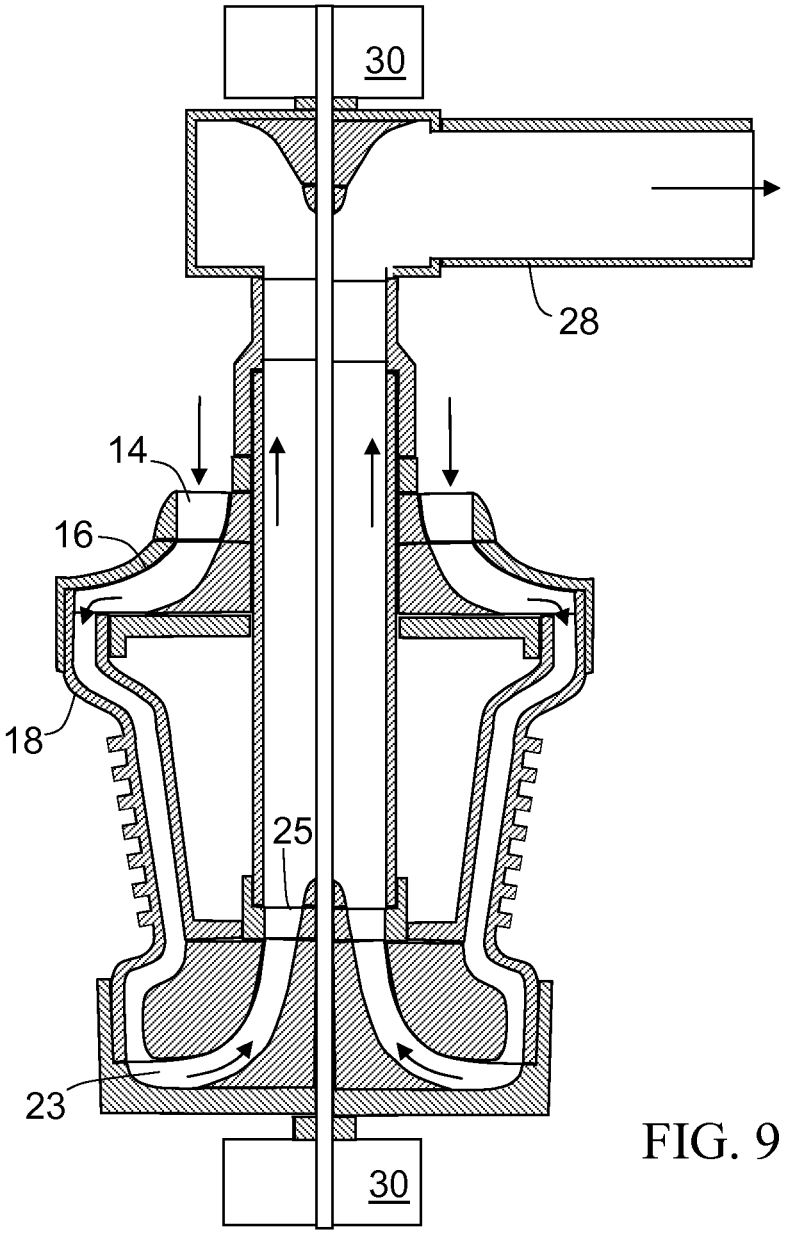
FIG. 9 shows a folded design of the invention.

The design of FIG. 5 can be folded and made more compact as shown in FIG. 9. Air enters through the inlet fan, is accelerated by the inlet impellers 16, goes through the heat exchanger 18, is decelerated by the outlet impellers 23, goes through the outlet fan 25, and goes through baffles 31 that stop its rotation and exits through the outlet manifold. A motor can be placed at either or both ends of the device.

The thickness of the boundary layer within the heat exchanger can be reduced by forcing the air to move with respect the wall of the centrifuge. There are several methods to achieve this effect. The compressor blades can be shaped to lean forward such that the air moves faster than the centrifuge as it leaves the compressor. Alternatively, the radius of the centrifuge can be tapered along the axial direction. Frictional speed losses can be compensated by providing the centrifuge with a conical shape. Restoring the speed of the air to match the speed of the centrifuge can be done by increasing the radius of the centrifuge along the axial direction.

Figure 10:
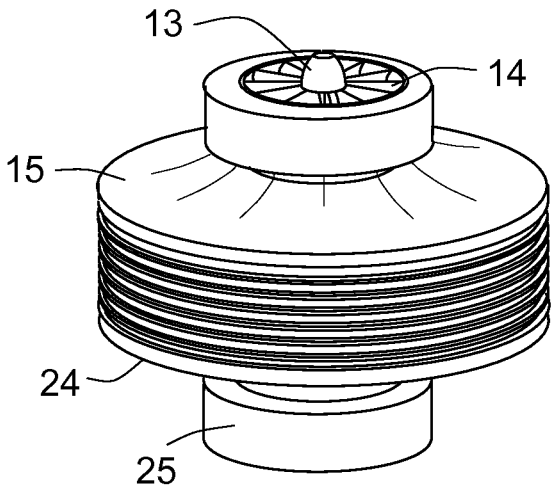
FIG. 10 provides a top view of a centrifuge variation that utilizes the Coriolis Effect to force the air movement inside the heat exchanger.
Figure 12:
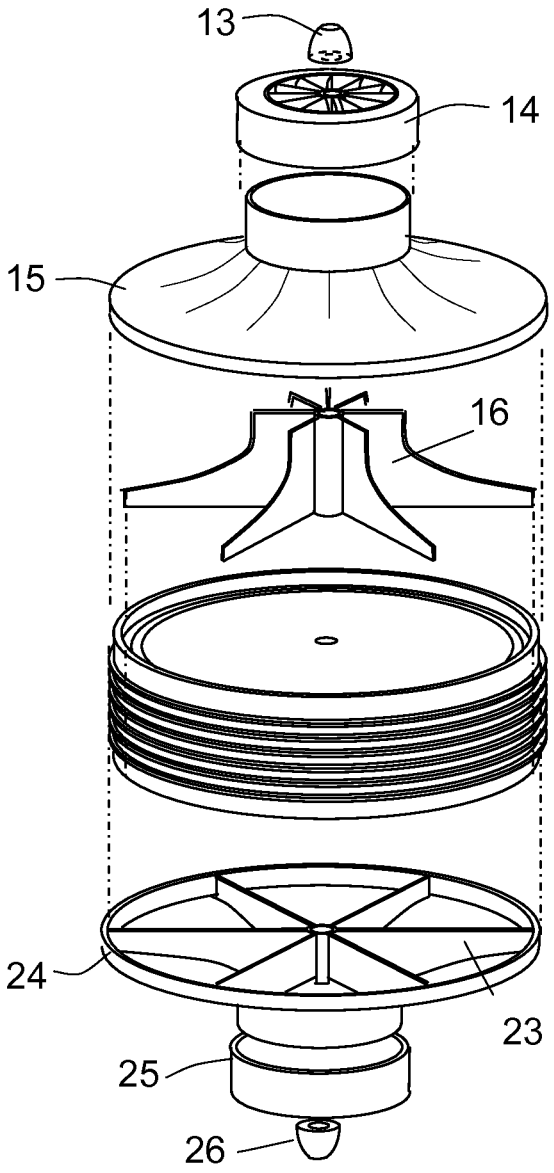
FIG. 12 is an exploded view of the centrifuge variation that utilizes the Coriolis Effect to force the air movement inside the heat exchanger.
Figure 13:
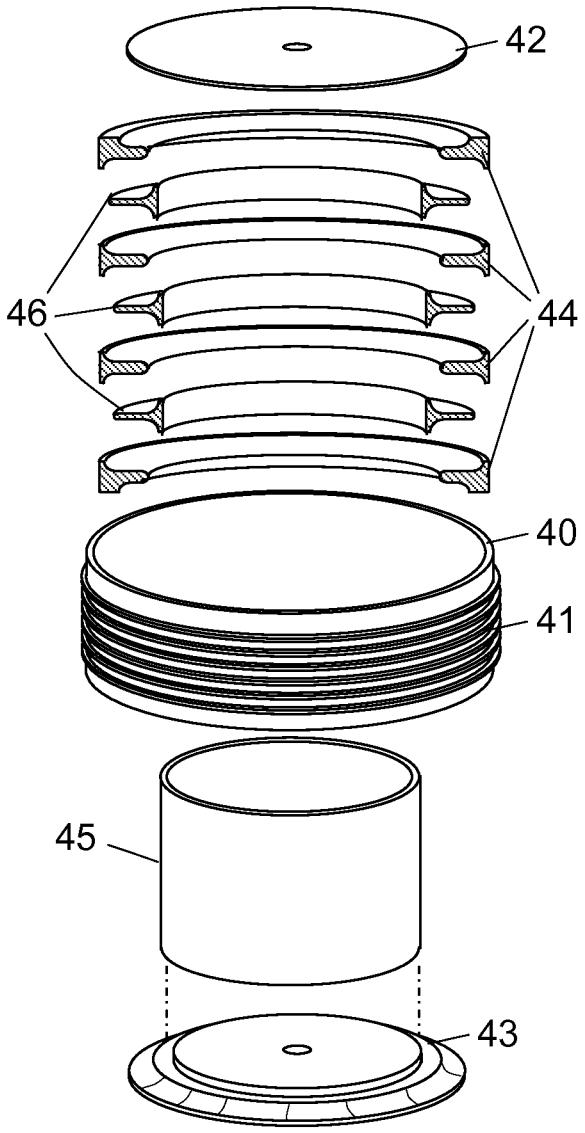
FIG. 13 is an exploded view of the heat exchanger variation that utilizes the Coriolis Effect to force the air movement inside the heat exchanger.

Many variations are possible on the basic theme of the invention. FIGS. 10 through 14 present another embodiment. FIG. 10 shows a top view, and FIG. 11, a cross sectional view of the centrifuge. FIG. 12 provides an exploded view of the centrifuge showing its stack architecture. FIG. 13 shows a detailed exploded view of the heat exchanger and FIG. 15 shows in cross section, several heat exchanger configurations.

The device is held together in a sandwich by two axial nuts 13 and 26. Two caps 15 and 24 are positioned on either sides of the device. The first cap 15 covers the compressor impellers 16. The second cover 24 covers the expander impellers 23.

Figure 11:
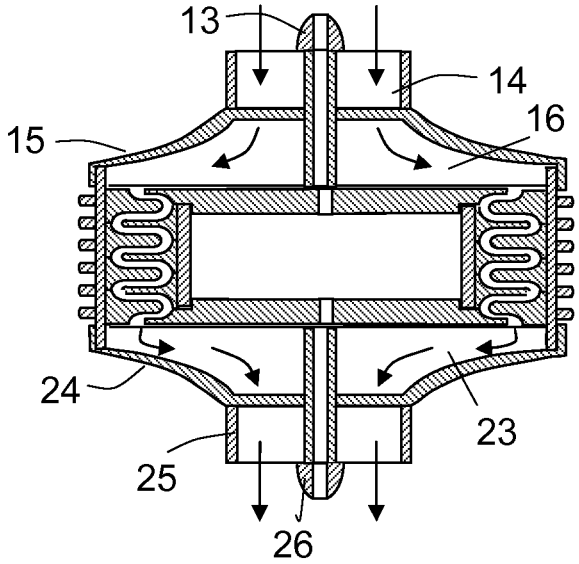
FIG. 11 is a cross-sectional view of the centrifuge variation that utilizes the Coriolis Effect to force the air movement inside the heat exchanger.

As can be observed from FIG. 11, the heat exchanger is shaped to provide a serpentine path for the air to follow. It is essentially cylindrical and directs the air to flow against the corrugated inner wall of a cylinder.

FIG. 13 provides an exploded cross-sectional view of the heat exchanger. It comprises an outer cylindrical shell 40 carrying fins 41 on its external surface for heat dissipation, and two end disks 42 and 43 forming the bases of the cylinder. Heat dissipation fins 44, annular in shape, are inserted within and make thermal contact with, the shell 40. The core 45 is a cylinder coaxial with the shell. Guide fins 46 also annular in shape and essentially conforming to the heat dissipation fins 44 are inserted over the core 45. The heat dissipation fins 44 and the guide fins 46 are separated to allow a serpentine path for the air to flow through.

As can be seen, the heat exchanger is built in the rim of the centrifuge. It performs very efficiently because of the forced convection of the air. On the outside, the thickness of the boundary layer is reduced by the rapid rotation of the centrifuge. On the inside, the thickness of the boundary layer is reduced by the Coriolis Effect. As the air flows along the serpentine path, it is forced to move radially, alternatively closer and further away from the axis. This radial movement generates tangential Coriolis forces, alternatively clockwise and counterclockwise, which force the air to move in the tangential direction and therefore reduce the thickness of the boundary layer.

Figure 14:
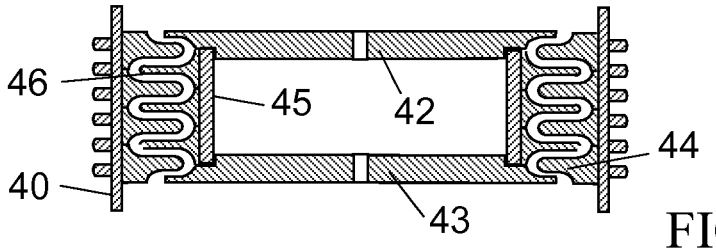
FIG. 14 provides one possible embodiment for the heat exchanger variation that utilizes the Coriolis Effect to force the air movement inside the heat exchanger. This variation utilizes annular heat dissipation fins and annular guide fins.
Figure 14A:
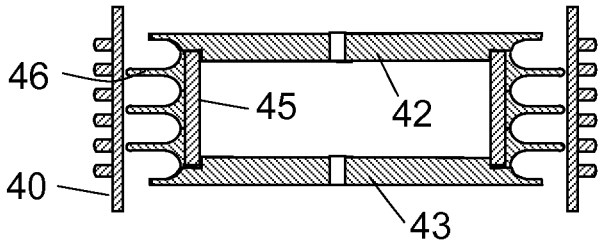
FIG. 14A provides one possible embodiment for the heat exchanger variation that utilizes the Coriolis Effect to force the air movement inside the heat exchanger. This variation utilizes screw-shaped guide fins.
Figure 14B:
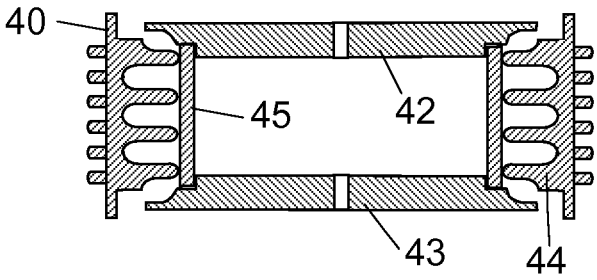
FIG. 14B provides one possible embodiment for the heat exchanger variation that utilizes the Coriolis Effect to force the air movement inside the heat exchanger. This variation utilizes screw-shaped heat dissipation fins.
Figure 14C:
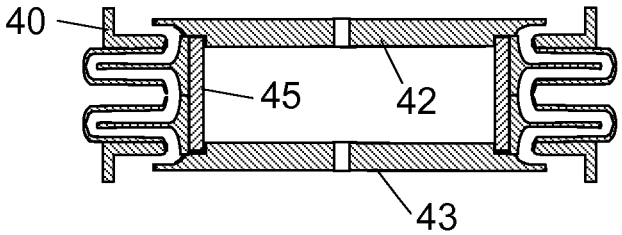
FIG. 14C provides one possible embodiment for the heat exchanger variation that utilizes the Coriolis Effect to force the air movement inside the heat exchanger. This variation utilizes an accordion-shaped shell.

The heat exchanger fin configuration can take many forms as shown in FIGS. 14 through 14C. The heat exchanger fins 44 and guide fins 46 can be annular as in FIG. 14. Alternatively the guide fins 46 can be helicoidal and winding male-screw-like around the core 45 as shown in FIG. 14A. In this version no heat dissipation fin is needed and the air flows in a helicoidal fashion without relying on the Coriolis force. Yet in another variation illustrated in FIG. 14B the heat dissipation fins 44 can be helicoidal winding female-screw-like inside the shell 40. In this version no guide fin 46 is needed and the Coriolis force is not needed. Yet in one more version shown in FIG. 14C, the heat dissipation fins 44 can be replaced by shaping the shell 40 as an accordion, essentially conforming to the guide fins 46.

FIG. 14 shows an embodiment for the heat exchanger. It comprises:

a) an external generally cylindrical wall made of highly heat-conductive material. This wall carries on its inside surface, a first set of essentially tangentially oriented corrugations;

b) an internal generally cylindrical core concentric with the external cylindrical wall and comprising on its outside surface, a set of essentially tangentially oriented protuberances. The set of corrugations and the set of protuberances conforming to each other, essentially forming matching parallel serpentine surfaces and defining between themselves said serpentine path;

c) The corrugations operate as heat fins, capturing heat from said compressed air and discharging the heat outside of the rim.

d) each corrugation is an independent annulus having a predetermined radius and each protuberance is also an independent annulus having a radius smaller than the corrugation's radius. The corrugations annuli are alternatively stacked with the protuberance annuli in a sandwich, thereby forming the serpentine path between the corrugations and the protuberances.

Variations in the above theme includes as shown in FIG. 4B shaping the corrugations as female screws that wind on the inner surface of the heat exchanger or, as shown in FIG. 4A, shaping the protuberances as male screws that wind around the outer surface of the core.

While the above description contains many specificities, the reader should not construe these as limitations on the scope of the invention, but merely as exemplifications of preferred embodiments thereof. Those skilled in the art will envision many other possible variations within its scope. Accordingly, the reader is requested to determine the scope of the invention by the appended claims and their legal equivalents, and not by the examples which have been given.

I claim:

1. An air cooling system using an air cycle, comprising a centrifuge having a rim, a first end and a second end, said air cooling system comprising:

a) an inlet axially located with respect to said centrifuge, said inlet receiving air to be cooled;

b) a compressor mounted in said first end of, and rotating with, said centrifuge, said inlet configured to guide said air into said compressor, said compressor comprising a first set of impeller blades that rotate in unison with said centrifuge and that direct said air against the inside of said rim of said centrifuge, thereby compressing and adiabatically heating said air;

c) a heat exchanger mounted on said rim of, and rotating in unison with, said centrifuge, said compressor configured to guide said compressed air to said heat exchanger, said heat exchanger cooling said compressed air;

d) an expander mounted in said second end of, and rotating with, said centrifuge, said heat exchanger configured to guide said cooled compressed air into said expander, said expander comprising a second set of impeller blades that guide said cooled compressed air toward the center of said centrifuge, and that decompress and further adiabatically cool said cooled compressed air, said second set of impeller blades rotating in unison with said centrifuge;

e) an outlet axially located with respect to said centrifuge, said expander configured to guide said cooled decompressed air to said outlet, said outlet discharging said decompressed cooled air;

f) said centrifuge being driven by at least one motor. [motor; and g) wherein said centrifuge has a predetermined angular speed, and wherein said rim deviates from the cylindrical form, said rim having an inlet end and an outlet end, and, furthermore said rim having a maximum radius at said inlet end and tapers down toward said outlet end thereby accelerating said air to an angular speed greater than said predetermined angular speed of said centrifuge, and countering the effect of friction.]

2. The air cooling system of claim 1 wherein said external wall comprises on its outside surface a set of corrugations configured in a helicoidal shape, said set of corrugations operating as heat fins to dissipate heat to the outside of said rim.

3. The air cooling system of claim 1 wherein said external wall comprises on its outside surface a set of essentially tangential corrugations, said set of corrugations operating as heat fins to dissipate heat to the outside of said rim.

4. The air cooling system of claim 3 wherein at least one comb structure is positioned such that the teeth of said comb are inserted inside said corrugations without making contact with said external wall, thereby reducing the thickness of the boundary layer of the air outside said heat exchanger.

5. The air cooling system of claim 1 wherein said air to be cooled originates from a refrigerator cabinet, the combination of said air cooling system and said refrigerator cabinet forming a refrigerator.

6. The air cooling system of claim 1 wherein said decompressed cooled air is discharged inside a building, said air cooling system thereby operating as an air conditioner.

7. The air cooling system of claim 1 wherein said centrifuge is supported by mechanical bearings.

8. The air cooling system of claim 1 wherein said centrifuge is supported by magnetic bearings.

9. The air cooling system of claim 1 wherein said centrifuge is supported by air foil bearings.

10. The air cooling system of claim 1 wherein said centrifuge is driven by at least one hub motor.

11. The air cooling system of claim 1 wherein said centrifuge is driven by at least one outrunner motor.

12. The air cooling system of claim 1 wherein said inlet is located at said first end of said centrifuge and said outlet is located at said second end of said centrifuge.

13. The air cooling system of claim 1 wherein said inlet and said outlet are coaxially located, both at said first end or both at said second end of said centrifuge.

14. The air cooling system of claim 1 wherein said centrifuge is partially or completely enclosed in a wire mesh.

15. The air cooling system of claim 1 wherein said centrifuge has a predetermined angular speed, and wherein said rim deviates from the cylindrical form, said rim having an inlet end and an outlet end, and, furthermore said rim having a maximum radius at said inlet end and tapers down toward said outlet end thereby accelerating said air to an angular speed greater than said predetermined angular speed of said centrifuge, and countering the effect of friction.

16. A method of cooling air with air cooling system of claim 1 comprising:

a) compressing said air in said centrifuge thereby heating air adiabatically against the rim of said centrifuge and generating hot air;

b) reducing the temperature of said hot air by passing said hot air through said heat exchanger located in said rim of, and rotating in unison with, said centrifuge, thereby producing cooled air;

c) accelerating said air with respect the centrifuge by varying the radius of the centrifuge along the axial direction; and d) expanding said cooled air in said expander configured within said centrifuge, thereby further cooling said cooled air, thereby producing cold air.

17. An air cooling system using an air cycle, comprising a centrifuge having a rim, a first end and a second end, said air cooling system comprising:

a) an inlet axially located with respect to said centrifuge, said inlet receiving air to be cooled;

b) a compressor mounted in said first end of, and rotating with, said centrifuge, said inlet configured to guide said air into said compressor, said compressor comprising a first set of impeller blades that rotate in unison with said centrifuge and that direct said air against the inside of said rim of said centrifuge, thereby compressing and adiabatically heating said air;

c) a heat exchanger mounted on said rim of, and rotating in unison with, said centrifuge, said compressor configured to guide said compressed air to said heat exchanger, said heat exchanger cooling said compressed air;

d) an expander mounted in said second end of, and rotating with, said centrifuge, said heat exchanger configured to guide said cooled compressed air into said expander, said expander comprising a second set of impeller blades that guide said cooled compressed air toward the center of said centrifuge, and that decompress and further adiabatically cool said cooled compressed air, said second set of impeller blades rotating in unison with said centrifuge;

e) an outlet axially located with respect to said centrifuge, said expander configured to guide said cooled decompressed air to said outlet, said outlet discharging said decompressed cooled air;

f) said centrifuge being driven by at least one motor; and g) wherein said heat exchanger of said centrifuge comprise i. an external generally cylindrical wall made of highly heat-conductive material, said external wall comprising, on its inside surface, a first set of essentially tangentially oriented corrugations;

ii. an internal generally cylindrical core concentric with said external cylindrical wall and comprising on its outside surface, a set of essentially tangentially oriented protuberances, said first set of corrugations and said set of protuberances conforming to each other, essentially forming matching parallel serpentine surfaces and defining between themselves said serpentine path;

iii. said first set of corrugations operating as heat fins, capturing heat from said compressed air and discharging said heat outside of said rim;

iv. each said corrugation being an independent annulus having a predetermined radius and each said protuberance also being an independent annulus having a radius smaller than said corrugation's radius, each said corrugations annulus being alternatively stacked with each said protuberance annulus in a sandwich, thereby forming said serpentine path between said corrugations and said protuberances.

* * * * *